United States Patent [19]

Dobashi

[11] Patent Number: 5,004,222

[45] Date of Patent: Apr. 2, 1991

[54] APPARATUS FOR CHANGING THE DIRECTION OF CONVEYING PAPER

[75] Inventor: Kenji Dobashi, Saitama, Japan

[73] Assignee: Fuji Xerox Co., Ltd., Tokyo, Japan

[21] Appl. No.: 364,151

[22] Filed: Jun. 12, 1989

Related U.S. Application Data

[63] Continuation-in-part of Ser. No. 193,099, May 12, 1988, abandoned.

[30] Foreign Application Priority Data

May 13, 1987 [JP] Japan ..... 62-114767

[51] Int. Cl.[5] ..... B65H 5/00

[52] U.S. Cl. ..... 271/225; 271/184; 271/273

[58] Field of Search ..... 271/225, 184, 265, 273, 271/272

[56] References Cited

U.S. PATENT DOCUMENTS 4,061,329 12/1977 Sachuk et al. ..... 271/225 X
4,483,530 11/1984 Spencer et al. ..... 271/265 X

FOREIGN PATENT DOCUMENTS 115543 9/1980 Japan ..... 271/225
41132 2/1987 Japan ..... 271/184

*Primary Examiner*—David H. Bollinger
*Attorney, Agent, or Firm*—Finnegan, Henderson, Farabow, Garrett, and Dunner

[57] ABSTRACT

An apparatus for changing the direction of conveying paper in which paper is stopped by the operation of driving roller pairs in conjunction with idle roller pairs. The respective driving and idle roller pairs are urged against one another by the operation of a solenoid or the like. In order to move the paper, a clutch is engaged to rotatably operate the driving pairs.

4 Claims, 1 Drawing Sheet

APPARATUS FOR CHANGING THE DIRECTION OF CONVEYING PAPER

This application is a continuation-in-part of application Ser. No. 07/193,099, filed May 12, 1988, now abandoned.

FIELD OF THE INVENTION

The present invention relates to an apparatus for changing the direction of conveying paper by 90 degrees, in a paper folding device or the like.

BACKGROUND OF THE INVENTION

Conventionally, in an apparatus for changing the direction of conveying paper by 90 degrees, the paper is made to register or to abut against a metal plate stopper or the like. The paper is then pulled to a lower guide plate, while a transverse conveying force is exerted to the paper to send the paper out of the lower guide plate. Generally, with the conventional machine, a paper conveying system constitutes a combination of a belt and a ball to give the paper freedom rightward and leftward so that the paper can be moved in a transverse direction.

Difficulties have been encountered in the art as a result of the inability of the conventional apparatus to control paper of varying thickness. More precisely, if the conveying direction of a thin sheet of paper and paper folded several times is to be changed by 90 degrees by the above-mentioned apparatus, the thin sheet is deformed by the strong force necesary for conveying a thick folded sheet on one hand, while the thin sheet conveying force is insufficient for conveying a thick sheet. Thus, it is exceedingly difficult to determine the appropriate force for the paper being conveyed.

SUMMARY OF THE INVENTION

An object of the present invention is to provide an apparatus for changing the direction of conveying paper independently of the kind or size of paper.

Another object of the present invention is to overcome the problems and disadvantages of the prior art.

To achieve the above and other objects and in accordance with the purpose of the invention, as embodied and broadly described herein, an apparatus for changing the direction of conveying paper according to the present invention, comprises an apparatus for changing the direction of paper conveyed therethrough comprising: a lower guide plate; first driving rollers for conveying the paper in a first direction so as to pull the paper onto said lower guide plate; second driving rollers for conveying the paper in a second direction perpendicular to the first direction so as to send out the paper from said lower guide plate; first idle rollers capable of abutting against said first driving rollers; second idle rollers capable of abutting against said second driving rollers; a driving source; and a clutch means for communicating the driving force according to said driving source to said first and second driving rollers.

The accompanying drawing, which is incorporated in and constitute a part of this specification, illustrates one embodiment of the invention and together with the description, serves to explain the principles of the invention.

FIG. 1 is a perspective view showing an embodiment of the apparatus for changing the direction of conveying paper according to the present invention.

DESCRIPTION OF THE PREFERRED EMBODIMENTS

Figure 1:
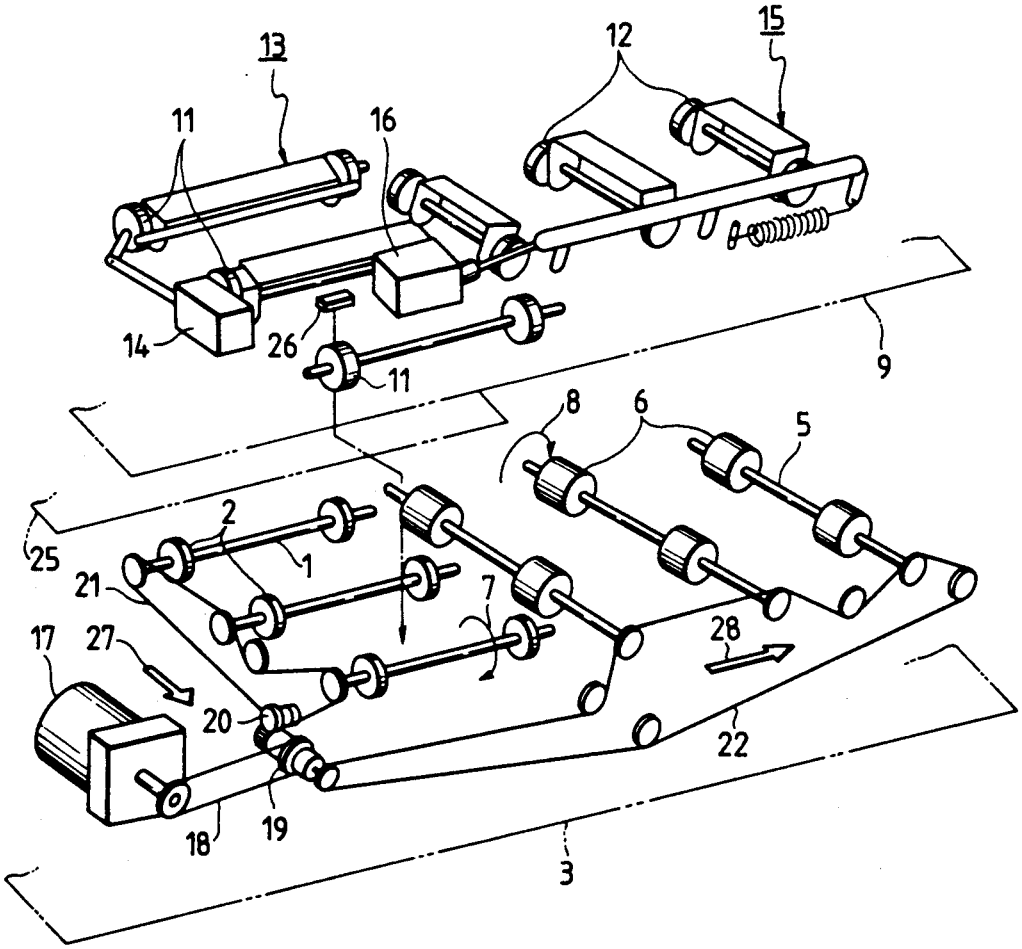

In the apparatus for changing the direction of conveying paper according to the present invention, first idle roller pairs are urged against corresponding first driving roller pairs by the operation of a solenoid or the like, and at the same time the first driving roller pairs are connected to a driving source through a clutch to pull paper to a lower guide plate. The clutch is released and the first idle roller pairs are separated from the first driving roller pairs upon arrival of the paper at a predetermined position. Second idle roller pairs are urged against corresponding second driving roller pairs and simultaneously the second driving roller pairs are connected to the driving source through the clutch to send the paper out of the lower guide plate. The paper is conveyed in such a manner as described above, so that the conveying direction of the paper can be changed by 90 degrees irrespective of the kind or size of paper.

In FIG. 1, a plurality of pairs of first driving rollers 2 (three pairs in this embodiment) are disposed above a lower guide plate 3. Each roller pair 2 is fixed on a shaft 1. The pairs of first driving rollers 2 project partly at their circumferences upwardly from the lower guide plate 3. Similarly, a plurality of pairs of second driving rollers 6 each fixed on shafts 5 project partly at their circumferences upwardly from the lower guide plate 3. The pairs of first driving rollers 2 are arranged to rotate in the direction indicated by an arrow 7 and the pairs of second driving rollers 6 are arranged to rotate in a direction perpendicular to the rotating direction of the pairs of first driving rollers 2, as indicated by an arrow 8, in such a manner as will be described later.

A plurality of first and second idle roller pairs 11 and 12 are disposed correspondingly to the first and second driving roller pairs 2 and 6, respectively, on an upper guide plate 9 that is disposed above the lower guide plate 3. The first and second idle roller pairs 11 and 12 are projected downwardly partly at their circumferences from the upper guide plate 9. When a paper pull-in solenoid 14 is in an on-state, supporting mechanisms 13 for the respective first idle roller pairs 11 are connected to the paper pull-in solenoid 14, and to cause the first idle roller pairs 11 to abut against corresponding first driving roller 2. Furthermore, when a paper send-out solenoid 16 is in an on-state, supporting mechanisms 15 the paper send-out solenoid 16 causes the second idle roller pairs 12 to abut against corresponding second driving roller pairs 6.

The sprocket of a driving source 17, e.g. an electric motor, is connected to a sprocket of a clutch 19 through a chain 18. The clutch 19 is connected to sprockets provided at one end of each of the shafts 1 of the first driving roller pairs 2 through a bevel gear 20 and a chain 21. The clutch 19 is further connected to sprockets provided at one end of each of the shafts 5 of the second driving roller pairs 6 through a chain 22. The clutch 19 is an electro-magnetic clutch. When the clutch 19 is turned on, the driving force according to the driving source 17 is communicated to the first driving roller pairs 2 and the second driving roller pairs 6 respectively through the clutch 19, so that the first and second driving roller pairs 2 and 6 are rotated simultaneously. Of course, when the clutch 19 is turned off, the first and second driving roller pairs 2 and 6 are not rotated. A sensor 26, for detecting the pasage of the paper 25, is provided in a position above the first driving roller pairs 2.

When the paper 25 is conveyed to the first driving roller pairs 2 by a conveying means not shown, the paper pull-in solenoid 14 is turned on so that the first idle roller pairs 11 abut against the first driving roller pairs 2. Next, the clutch 19 is turned on so that the first driving roller pairs 2 and the second driving roller pairs 6 are rotated. In this way the paper 25 is conveyed in the direction indicated by an arrow 27. Here, the conveyance of the paper 25 in the direction indicated by the arrow 27 is not affected by the rotation of the second driving roller pairs 6. When the sensor 26 detects that the paper 25 arrives at a predetermined position, the clutch 19 is turned off, continuously first driving roller pairs 2 the shafts 1. Once the paper the solenoid 14 is turned off so that the first idle roller pairs 11 are separated from the first driving roller pairs 2 to stop the paper 25 from being conveyed.

Here, the paper 25 is stopped without using a conventional stopper such as a metal plate. Instead, the paper 25 is stopped by the operation of the first idle roller pairs 11 and the first driving roller pairs 2 which cause the paper to be registered in a selected position regardless of particular paper properties such as variations in thickness and the like.

Next, the paper send-out solenoid 16 is turned on so that the second idle roller pairs 12 abut against the second driving roller pairs 6. Continuously, the clutch 19 is turned on so that the first driving roller pairs 2 and the second driving roller pairs 6 are rotated. In this way the paper 25 is conveyed in the direction indicated by an arrow 28 and is held between the second idle roller pairs 12 and the second driving roller pairs 6 to send out the paper 25 from the lower guide plate 3. Here, the conveyance of the paper 25 in the direction indicated by the arrow 28 is not affected by the rotation of the first driving roller pairs 2. After the paper 25 is sent out from the lower guide plate 3, the clutch 19 is turned off, continuously the solenoid 16 is turned off. Provided that the paper 25 is conveyed to the first driving roller pairs 2 in succession, the solenoid 14 is turned on before the solenoid 16 is turned off, and the clutch 19 is turned on after the solenoid 16 is turned off, such that the above-described operation is repeated. As described above, according to the present invention, the pairs of first driving rollers 2 for pulling-in paper 25 and the pairs of second driving rollers 6 for sending-out paper 25 are rotated through the clutch 19, and the idle roller pairs 11, 12, respectively corresponding to the driving roller pairs 2, 6 are urged in sequence against the corresponding roller pairs so that it is possible to change the conveying-direction of paper 25, e.g., by 90 degrees, and convey the paper 25 surely without being influenced by the kind of paper.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An apparatus for changing the direction of paper of varying sizes and thicknesses conveyed therethrough comprising:

a lower guide plate;

first driving rollers for conveying the paper in a first direction so as to pull the paper into said lower guide plate;

second driving rollers for conveying the paper in a second direction perpendicular to the first direction so as to send out the paper from said lower guide plate;

first idle rollers selectively movable into and out of abutting engagement with said first driving rollers to selectively hold the paper between said first idle rollers and said first driving rollers;

second idle rollers selectively movable into and out of abutting engagement with said second driving rollers to selectively hold the paper between said second idle rollers and said driving rollers;

first means for moving said first idle rollers into engagement with said first driving rollers to convey the paper in said first direction;

second means for moving said second idle rollers into engagement with said second driving rollers when said first idle rollers are out of engagement with said first driving rollers to convey the paper in said second direction;

a driving source for generating a driving force; and a clutch means for selectively communicating said driving force to said first and second driving rollers to rotate the first and second driving rollers simultaneously.

2. An apparatus according to claim 1, further including a sensor for detecting when the paper conveyed by said first driving rollers arrives at a predetermined position, whereby an abutting state against said first driving rollers of said first idle rollers by said first means for moving said first idle rollers is cancelled, and simultaneously an abutting state against said second driving rollers of said second idle rollers is achieved by said second means for moving said second idle rollers, in response to the output from said sensor.

3. An apparatus according to claim 2, wherein said first means for moving said first idle rollers is a solenoid and said second means for moving said second idle rollers is a solenoid.

4. A process for changing the direction of paper of varying sizes and thicknesses in a paper conveying apparatus, comprising the steps of:

providing a first driving roller arranged for rotation in a first direction;

providing a second driving roller arranged for rotation in a second direction, said second direction different from said first direction;

providing a first idle roller and a second idle roller for movement into and out of engagement with said first driving roller and said second driving roller, respectively;

abutting said first idle roller against said first driving roller to hold the paper between said first driving roller and said first idle roller and maintaining said second idle roller separate from said second driving roller;

rotating said first and second driving rollers to transfer the paper in said first direction;

stopping the transfer of said paper in said first direction by the steps of stopping the rotating of said first and second driving rollers and separating said first idle roller from said first driving roller;

abutting said second idle roller against said second driving roller to hold the paper between said second driving roller and said second idle roller and maintaining said first idle roller separate from said first driving roller; and rotating said first and second driving rollers to transfer the paper in said second direction.

* * * * *